US008286963B2

(12) United States Patent
Matsumoto et al.

(10) Patent No.: US 8,286,963 B2
(45) Date of Patent: Oct. 16, 2012

(54) SHEET HANDLING APPARATUS

(75) Inventors: Yuji Matsumoto, Yokohama (JP); Yukio Asari, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1780 days.

(21) Appl. No.: 11/222,975

(22) Filed: Sep. 12, 2005

(65) Prior Publication Data

US 2007/0040325 A1 Feb. 22, 2007

(30) Foreign Application Priority Data

Aug. 16, 2005 (JP) ..... 2005-236007

(51) Int. Cl.
*B65H 29/00* (2006.01)

(52) U.S. Cl. ..... 271/186; 271/202

(58) Field of Classification Search ..... 271/186, 271/185, 202
See application file for complete search history.

(56) References Cited

U.S. PATENT DOCUMENTS

| | | | | |
|---|---|---|---|---|
| 5,106,075 | A | 4/1992 | Wafford et al. | |
| 5,449,166 | A | 9/1995 | Lohmann et al. | |
| 6,107,579 | A * | 8/2000 | Kinnemann | 177/145 |
| 6,275,676 | B1 * | 8/2001 | Ushio | 399/401 |
| 6,419,222 | B1 * | 7/2002 | Morrison et al. | 271/186 |
| 6,450,711 | B1 | 9/2002 | Conrow | |
| 2003/0122299 | A1 * | 7/2003 | Soga et al. | 271/182 |
| 2004/0100017 | A1 | 5/2004 | Asari | |
| 2005/0067765 | A1 | 3/2005 | Watanabe et al. | |

FOREIGN PATENT DOCUMENTS

| | | | |
|---|---|---|---|
| EP | 0 536 778 | A1 | 4/1993 |
| EP | 1 424 299 | A2 | 6/2004 |
| JP | 61-183052 | | 8/1986 |
| JP | 08188318 | A * | 7/1996 |
| JP | 2004-175507 | | 6/2004 |
| JP | 2005-059969 | | 3/2005 |
| JP | 2005-138959 | | 6/2005 |
| JP | 2006056682 | A * | 3/2006 |

OTHER PUBLICATIONS

European Search Report dated Nov. 21, 2005 for Appln. No. 05019911.6-2314.
Japanese Office Action dated Jul. 13, 2010.

* cited by examiner

*Primary Examiner* — Michael McCullough
*Assistant Examiner* — Howard Sanders
(74) *Attorney, Agent, or Firm* — Pillsbury Winthrop Shaw Pittman, LLP

(57) ABSTRACT

A sheet handling apparatus comprises a switchback path including a switchback section, and a straight path that bypasses the switchback section. The controller of the sheet handling apparatus detects the conveyance-directional length of a sheet assigned to the switchback section, using a length sensor, and also detects the sheet conveyance rate of each path, thereby controlling a switchback roller based on the detection results.

10 Claims, 5 Drawing Sheets

SHEET HANDLING APPARATUS

CROSS-REFERENCE TO RELATED APPLICATIONS

This application is based upon and claims the benefit of priority from prior Japanese Patent Application No. 2005-236007, filed Aug. 16, 2005, the entire contents of which are incorporated herein by reference.

BACKGROUND OF THE INVENTION

1. Field of the Invention

The present invention relates to a sheet handling apparatus with a switchback section for selectively switching the conveyance direction of sheets.

2. Description of the Related Art

As a sheet handling apparatus of this type, a reverse control apparatus is known. This reverse control apparatus has a sensor for sensing the length of sheets in a first conveyance direction, and a reverse section for reversing the conveyance direction of the sheets into a second direction to cause the adjacent sheets to be forwarded in the second direction with the same gap therebetween (see, for example, Jpn. Pat. Appln. KOKAI Publication No. 2004-175507).

More specifically, in the reverse control apparatus, the length of each sheet to be fed to the reverse section is detected, and the pull-in amount of each sheet is adjusted based on the detection result, with the result that the gaps between adjacent sheets sent from the reverse section are made equal.

However, in the reverse control apparatus, it is assumed that the conveyance rate of sheets is constant between various sheet handling apparatuses. Therefore, when the conveyance rate is changed for some reason, or when the apparatuses employ different conveyance rates, the gaps between sheets sent from the reverse section cannot be kept constant, which reduces the reliability of the apparatus. For instance, if the conveyance belt for conveying sheets comes loose with time, or the load applied to the belt is varied, the conveyance rate may well be changed.

BRIEF SUMMARY OF THE INVENTION

It is an object of the invention to provide a sheet handling apparatus capable of realizing highly reliable conveyance control.

To attain the object, a sheet handling apparatus according to an embodiment of the invention comprises: a switchback section which reverses a conveyance direction of sheets; a switchback path which conveys sheets via the switchback section; a straight path which extends between a converging point and a confluence and bypasses the switchback section, the switchback path and the straight path diverging at the diverging point and joining at the confluence; a first rate-sensing section which senses a sheet conveyance rate of the switchback path; a second rate-sensing section which senses a sheet conveyance rate of the straight path; and a control section which controls the switchback section based on sensing results of the first rate-sensing section and the second rate-sensing section.

Further, a sheet handling apparatus according to another embodiment of the invention comprises: a switchback section which reverses a conveyance direction of sheets; a switchback path which conveys sheets via the switchback section; a straight path which extends between a converging point and a confluence and bypasses the switchback section, the switchback path and the straight path diverging at the diverging point and joining at the confluence; a first rate-sensing section which senses a sheet conveyance rate of the switchback path; a second rate-sensing section which senses a sheet conveyance rate of the straight path; a gap-sensing section which senses gaps between sheets directed to the diverging point; and a control section which controls the switchback section based on sensing results of the first rate-sensing section, the second rate-sensing section and the gap-sensing section.

In the above-described inventions, the conveyance rate of each sheet is detected, and the switchback section is controlled based on the detection result. Therefore, even if the conveyance rate of each sheet is varied, desired conveyance control can be executed and this enhances the reliability of the sheet handling apparatus.

A sheet handling apparatus according to yet another embodiment of the invention comprises: a switchback section which reverses a conveyance direction of sheets; a switchback path which conveys sheets via the switchback section; a straight path which extends between a converging point and a confluence and bypasses the switchback section, the switchback path and the straight path diverging at the diverging point and joining at the confluence; a conveyance section provided across a middle portion of the straight path and configured to vary a conveyance rate of each sheet conveyed through the straight path; a first rate-sensing section which senses a sheet conveyance rate of the switchback path; a second rate-sensing section which senses a sheet conveyance rate of the straight path; a gap-sensing section which senses gaps between sheets directed to the diverging point; and a control section which controls at least one of the switchback section and the conveyance section based on sensing results of the first rate-sensing section, the second rate-sensing section and the gap-sensing section, to control at least one of a handling period of a sheet assigned to the switchback section and a conveyance rate of a sheet directed to the straight path.

In the above-described invention, the conveyance rates of sheets and the gaps between the sheets are detected, and the switchback section and/or the conveyance section are controlled based on the detection results. Accordingly, even if the conveyance rate of each sheet is varied, desired conveyance control can be executed and this enhances the reliability of the sheet handling apparatus.

Additional objects and advantages of the invention will be set forth in the description which follows, and in part will be obvious from the description, or may be leaned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the invention will be described in detail with reference to the accompanying drawings.

Figure 1:
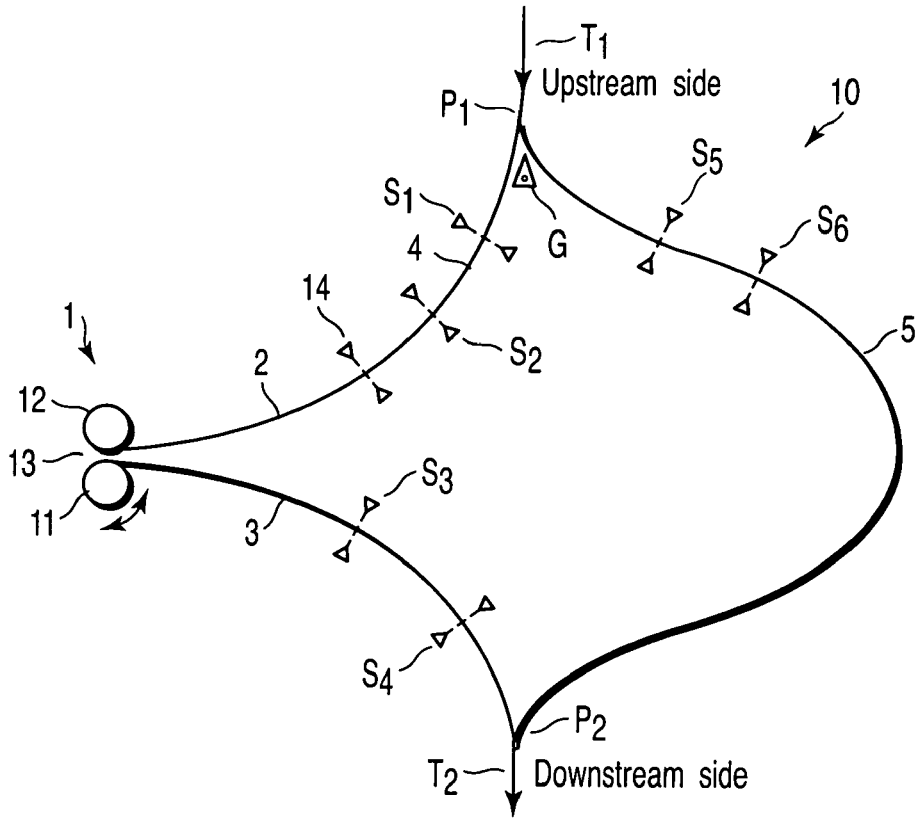
FIG. 1 is a schematic view illustrating the configuration of the essential parts of a sheet handling apparatus according to a first embodiment of the invention.

FIG. 1 schematically shows the configuration of the essential parts of a sheet handling apparatus 10 according to a first embodiment of the invention. In the sheet handling apparatus 10, some of the sheets conveyed from the upstream side are fed to a switchback section 1, where the conveyance direction of the sheets is switched back and guided to the downstream side. In contrast, the sheets that should not be switched back are diverted from the switchback section 1. Namely, the sheet handling apparatus 10 is used to selectively reverse the conveyance direction of sheets of mail articles, bank bills, etc.

The sheet handling apparatus 10 comprises a switchback pre-path (hereinafter, "pre-path") 2, a switchback post-path (hereinafter, "post-path") 3, and a straight path 5. The pre-path 2 guides, to the switchback section 1, the sheets conveyed from the upstream side (indicated by arrow T1 in FIG. 1) of the apparatus via a conveyance path (not shown). The post-path 3 guides, to the downstream side of the apparatus (indicated by arrow T2 in FIG. 1), the sheets fed to the switchback section 1 and having its conveyance direction switched back. The straight path 5 diverges from the pre-path 2, bypasses the switchback section 1, and meets the post-path 3. The combination of the pre-path 2 and post-path 3 serves as a switchback path 4 in the invention.

Basically, the sheet-conveyance rates at the paths 4 and 5, the handling time of each sheet at the switchback section 1 and the length of the straight path 5, etc., are set so that the time required for each sheet to pass the switchback path 4 will be equal to that required for each sheet to pass the straight path 5 between the diverging point P1 of the pre-path 2 and the straight path 5 and the confluence P2 of the post-path 3 and the straight path 5. However, if the conveyance belts (not shown) extending along the paths 4 and 5 come loose with time and vary in tension, or if slippage occurs between each belt and sheet, the sheet conveyance rates at the paths 4 and 5 will vary. Further, note that concerning the conveyance rates of the paths 4 and 5, slight variations exist between different handling apparatuses 10.

The switchback section 1 comprises a switchback roller 11 and pinch roller 12. The switchback roller 11 is brought into contact with one surface of each sheet fed from the pre-path 2, and is rotatable together with each sheet in both forward and backward directions. The pinch roller 12 opposes the switchback roller 11 with each sheet interposed therebetween. When the pinch roller 11 is brought into pressure contact with the switchback roller 12, it is rotated by the rotation of the switchback roller 12. When a sheet is fed to the switchback section 1, the switchback roller 11 is rotated forwardly to nip the sheet by a nip 13 between the rollers 11 and 12. At this time, the switchback roller 11 is accelerated, then decelerated and stopped. After that, the switchback roller 11 is backwardly rotated to send the sheet to the post-path 3. Thus, the sheet conveyance direction is reversed.

Figure 2:
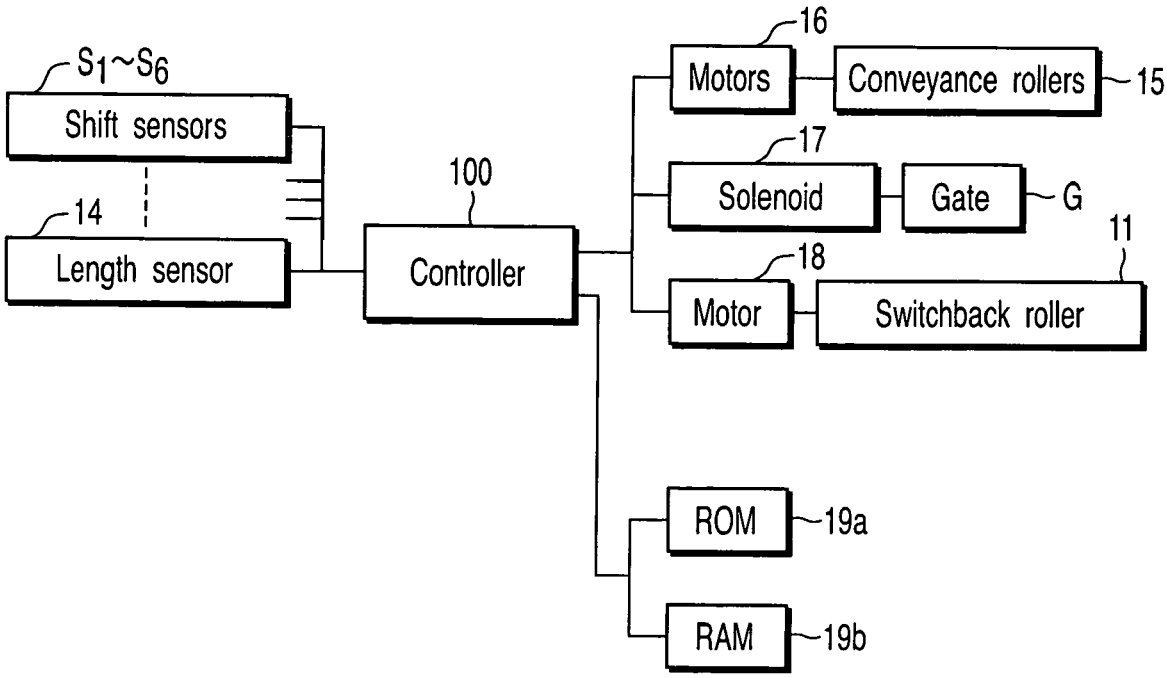
FIG. 2 is a block diagram illustrating a control system for controlling the operation of the sheet handling apparatus of FIG. 1.

FIG. 2 is a block diagram illustrating a control system for controlling the operation of the above-described handling apparatus 10. As shown, a controller 100 (control section) for controlling the operation of the sheet handling apparatus 10 is connected to a plurality (six in this embodiment) of shift sensors S1 to S6 and a length sensor 14 (length-sensing section). The shift sensors S1 to S6 are provided across the switchback path 4 and straight path 5 (the switchback path 4 and straight path 5 as a whole will hereinafter be referred to as "the conveyance path"). The length sensor 14 is provided across the pre-path 2. Each of the sensors S1 to S6 and 14 has a light-emitting section and light-receiving section opposing each other with the paths 4 and 5 interposed therebetween. When a sheet crosses the optical path between the light-emitting and light-receiving elements of each sensor, each sensor senses the passing of the sheet.

The shift sensors S1 to S6 sense the passing of the front or rear edge of each sheet in the conveyance direction, and determine the conveyance rate of each sheet based on the difference in sensing time between adjacent sensors. The shift sensors S1 to S4 provided across the switchback path 4 serve as first rate-sensing sections in the invention, and the shift sensors S5 and S6 provided across the straight path 5 serve as second rate-sensing sections in the invention. Further, the length sensor 14 determines the length of each sheet in the conveyance direction, based on the period ranging from the time when the front edge of each sheet is sensed, to the time when its rear edge is sensed. Note that encoders for detecting the rotational speeds of a plurality of conveyance rollers 15, described later, may be used for rate detection instead of the sensors S1 to S6.

The conveyance paths 4 and 5 are defined by groups of endless conveyance belts (not shown). Specifically, the conveyance belts are wound on the conveyance rollers 15, tensioned therebetween, so that they run endlessly with each conveyance path defined therebetween. Therefore, the sheet conveyance rate of each conveyance path can be controlled by controlling the rotation of the conveyance rollers 15 on which the conveyance belts are wound.

The controller 100 is connected to motors 16, solenoid 17, motor 18, ROM 19*a* and RAM 19*b*. The motors 16 are used to rotate the conveyance rollers 15. The solenoid 17 is used to operate the gate G provided at the diverging point P1 between the pre-path 2 and straight path 5. The motor 18 is used to rotate the switchback roller 11 at various rates in forward and backward directions. The ROM 19*a* and RAM 19*b* store various types of data.

Figure 3:
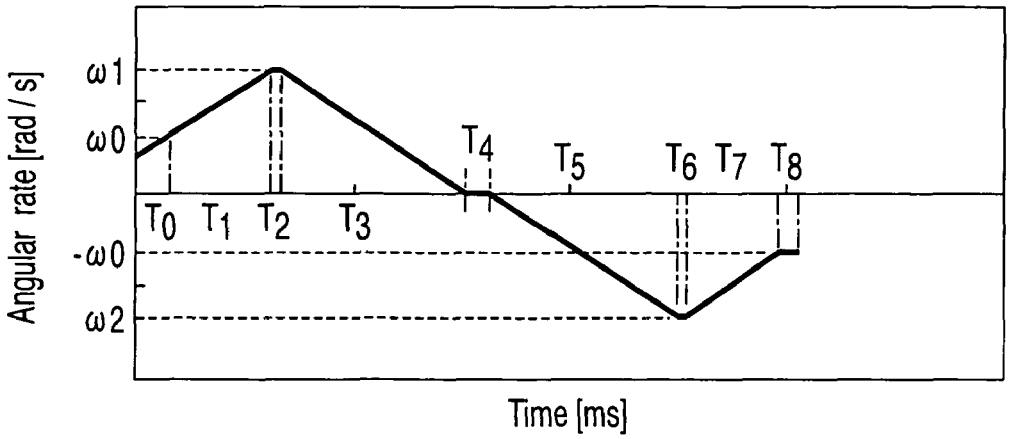
FIG. 3 is a timing chart illustrating the rotation control timing of a switchback roller corresponding to the length of sheets.
Figure 4:
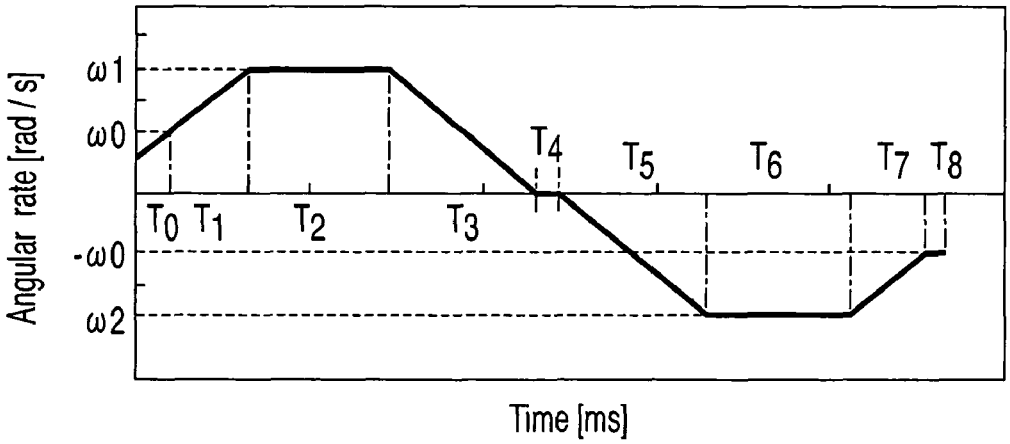
FIG. 4 is another timing chart illustrating the rotation control timing of a switchback roller corresponding to the length of sheets.
Figure 5:
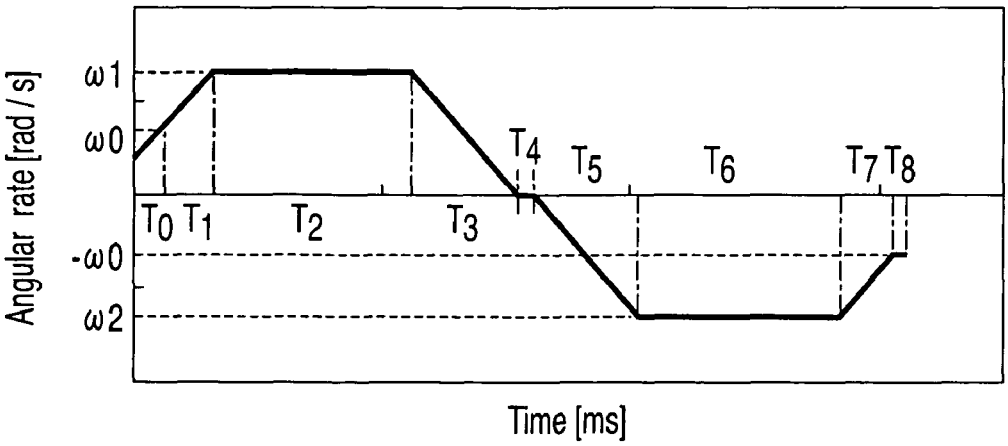
FIG. 5 is yet another timing chart illustrating the rotation control timing of a switchback roller corresponding to the length of sheets.

Referring to FIGS. 3 to 5, a description will be given of the sheet handling operation of the sheet handling apparatus 10 constructed as above.

Before operating the sheet handling apparatus 10, the sheet conveyance rates of the switchback path 4 and straight path 5 are detected. In this embodiment, a history of handling is beforehand stored in the RAM 19*b*. More specifically, the average conveyance rates acquired when several tens of sheets are conveyed along the conveyance paths 4 and 5 are beforehand detected and stored in the RAM 19*b* as the conveyance rates of the paths 4 and 5. The handling history, i.e., the average conveyance rates, is periodically updated. Note that the sheet conveyance rates of the paths 4 and 5 are not limited to such average values. Alternatively, the conveyance rate of each unit of handling, i.e., each sheet, may be detected and used for the above control.

When a sheet assigned to the switchback section 1 (i.e., a sheet to be switched back) is conveyed in the direction indicated by arrow T1, the controller 100 switches a gate G at a predetermined time to direct the sheet to the switchback path 4. While the sheet passes the pre-path 2, the controller 100 detects the conveyance rate of the sheet based on the outputs of the two sensors S1 and S2 separate from each other, and detects the length of the sheet in the conveyance direction based on the output of the length sensor 14. In the case of handling regular-size sheets, it is not necessary to detect their length.

The controller 100 controls the rotational speed of the switchback roller 11 so that the peripheral rate of the switchback roller 11 will be equal to the conveyance rate of the sheet when a predetermined period $T_0$ [s] elapses after detecting the length of the sheet using the length sensor 14 (i.e., after detecting the conveyance-directional rear edge of the sheet using the length sensor 14), i.e., when the conveyance-directional front edge of the sheet reaches the nip 13 of the switchback section 1. The target angular rate of the switchback roller 11 at this time is $\omega_0$ [rad/s].

After the conveyance-directional front edge of the sheet reaches the nip 13 between the rollers 11 and 12 of the switchback section 1 (i.e., after $T_0$ elapses), the controller 100 controls the switchback roller 11 in accordance with the conveyance-directional length of the sheet. For instance, FIG. 3 is a graph illustrating the rotation control timing of the switchback roller 11 when a sheet with a conveyance-directional length of 135 mm is handled. FIG. 4 is a graph illustrating the rotation control timing of the switchback roller 11 when a sheet with a conveyance-directional length of 195 mm is handled. FIG. 5 is a graph illustrating the rotation control timing of the switchback roller 11 when a sheet with a conveyance-directional length of 255 mm is handled.

Specifically, the controller 100 accelerates the switchback roller 11 by a period $T_1$ [s] after the conveyance-directional front edge of the sheet reaches the nip 13. By this operation, the peripheral rate of the switchback roller 11 becomes faster than the conveyance rate of the pre-path 2, thereby accelerating the conveyance rate of the sheet and pulling the sheet from the pre-path 2. After accelerating the angular rate of the switchback roller 11 up to $\omega_1$ [rad/s], the controller 100 maintains the switchback roller 11 at $\omega_1$ [rad/s] by a period $T_2$ [s].

After that, the controller 100 decelerates the switchback roller 11 by a period $T_3$ [s] to stop it. The periods $T_1$, $T_2$ and $T_3$ are set in accordance with the conveyance-directional length of the sheet, so that the projection of the conveyance-directional rear edge of the sheet from the nip 13 will have a predetermined length when the switchback roller 11 is stopped.

After a stop period $T_4$ [s], which is variable, elapses, the controller 100 accelerates the switchback roller 11 in the opposite direction by a period $T_5$ [s], thereby increasing the angular rate of the switchback roller 11 up to $\omega_2$ [rad/s]. The controller 100 maintains the angular rate of the switchback roller 11 at $\omega_2$ [rad/s] by a period $T_6$ [s]. The angular rate $\omega_2$ [rad/s] is higher than the sheet conveyance rate of the post-path 3.

Thereafter, the controller 100 decelerates the switchback roller 11 by a period $T_7$ [s] into $\omega_0$ [rad/s], and maintains it at $\omega_0$ [rad/s] by a period $T_8$ [s] that is required for the sheet to pass through the nip 13, thereby sending the sheet to the post-path 3. The sheet thus sent to the post-path 3 is passed through a confluence P2 and conveyed in the direction indicated by arrow T2 up to the next handling unit (not shown).

In contrast, when a sheet that is not necessary to be switched back is conveyed in the direction indicated by arrow T1, the controller 100 switches the gate G at the predetermined time, and directs the sheet to the straight path 5. The sheet on the straight path 5 is guided to bypass the switchback roller 11 and reach the position indicated by arrow T2.

As mentioned above, the sheet conveyance rates of the switchback path 4 and straight path 5 may well vary between different sheet handling apparatuses 10 or with time. In light of this, in this embodiment, the sheet conveyance rates of the conveyance paths 4 and 5 are detected, and sheet conveyance control is performed to cover variations in conveyance rate. Specifically, the conveyance-directional length of each sheet, and the conveyance rates of the switchback path 4 and straight path 5 are detected, and the rotational speed of the switchback roller 11 of the switchback section 1 is controlled based on the detection results.

For instance, the controller 100 controls the sheet handling period $T_{sb(x)}$ [s] of the switchback section 1 to satisfy the following equation:

$$L_{st}/V_{st}=(L_{sb}-L_{m(x)})/V_{sb}+T_{sb(x)}$$

where $L_{sb}$ [m] is the sum of the length of the pre-path 2 between the diverging point P1 of the switchback path 4 and the nip 13 of the switchback section 1, and the length of the post-path 3 between the nip 13 and the confluence P2, i.e., the length of the switchback path. Further, $L_{st}$ [m] is the length of the straight path 5 between the diverging point P1 and the confluence P2, $L_{m(x)}$ [m] is the conveyance-directional length of a sheet sensed by the length sensor 14, $V_{sb}$ [m/s] is the pre-detected sheet conveyance rate of the switchback path 4, $V_{st}$ [m/s] is the pre-detected sheet conveyance rate of the straight path 5, and $T_{sb(x)}$ [s] is the sheet handling time of the switchback section 1.

In this case, the sheet handling time $T_{sb(x)}$ [s] of the switchback section 1 includes, for example, $T_1$, $T_2$, $T_3$, $T_4$, $T_5$, $T_6$ and $T_7$ as shown in FIGS. 3 to 5. The time required for each sheet to pass through the switchback path 4 can be controlled by, for example, controlling the stop period $T_4$ [s], in which the switchback roller 11 is stopped, after each sheet is fed into the nip 13.

As described above, in the embodiment, the conveyance rate of each sheet in the switchback path 4 and that of each sheet in the straight path 5 are detected, and the handling time of each sheet at the switchback section 1 is controlled based on the detection results. Therefore, even if the sheet conveyance rates of the conveyance paths 4 and 5 are varied, the conveyance time between the converging point P1 and the confluence P2 can be made equal between the conveyance paths 4 and 5. Further, the gaps between sheets can be prevented from being varied between before and after they fed into the sheet handling apparatus 10, irrespective of whether they are conveyed through the path 4 or 5. Thus, highly reliable conveyance control is performed.

Figure 6:
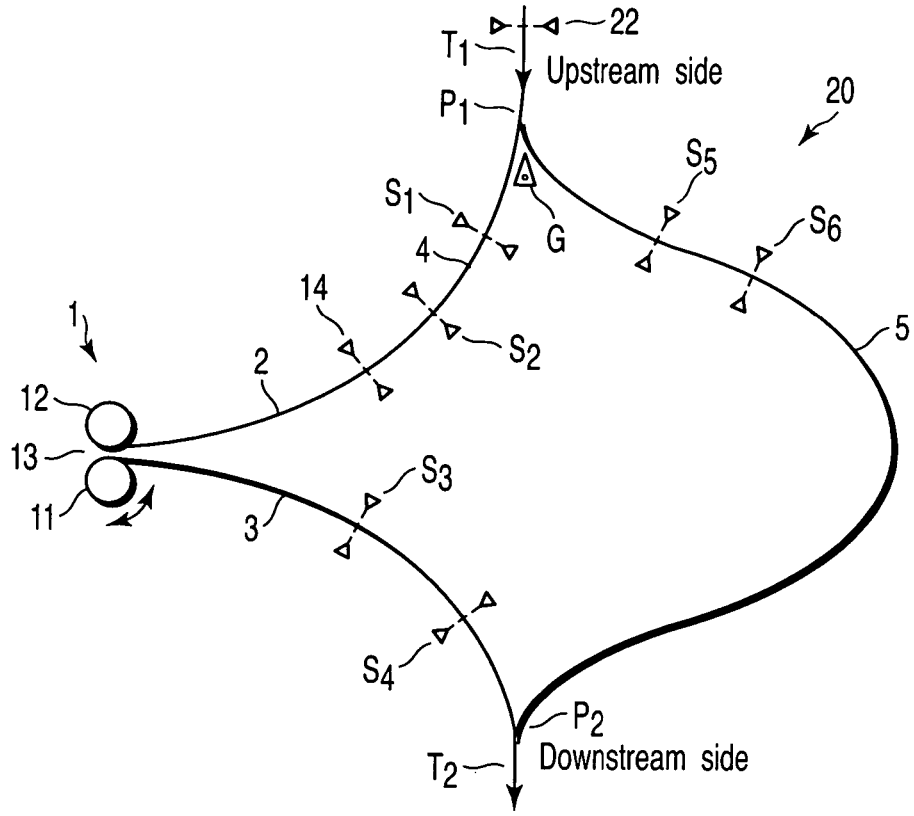
FIG. 6 is a schematic view illustrating the configuration of the essential parts of a sheet handling apparatus according to a second embodiment of the invention.
Figure 7:
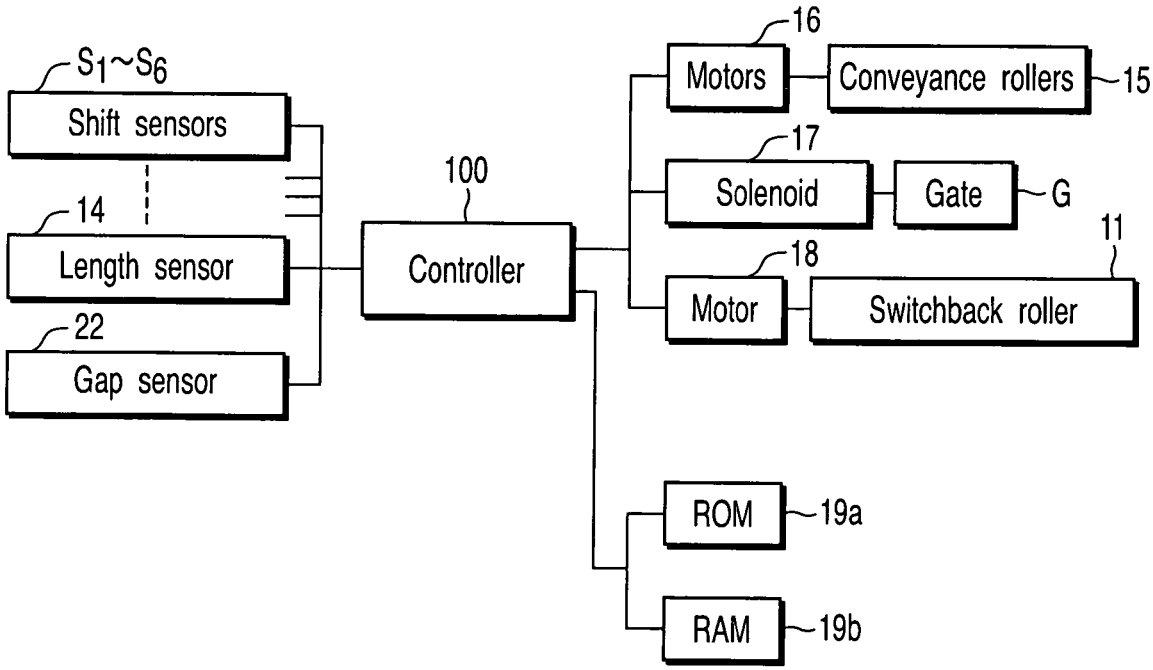
FIG. 7 is a block diagram illustrating a control system for controlling the operation of the sheet handling apparatus of FIG. 6.

Referring then to FIGS. 6 and 7, a description will be given of a sheet handling apparatus 20 according to a second embodiment. The sheet handling apparatus 20 is similar to the sheet handling apparatus 10 of the first embodiment, except that the former additionally employs a gap sensor 22 (gap-sensing unit) across the conveyance path upstream of the diverging point P1. Therefore, in the second embodiment, elements similar to those of the first embodiment are denoted by corresponding reference numerals, and no detailed description is given thereof.

As mentioned above, the sheet handling apparatus 20 includes a gap sensor 22 across the conveyance path upstream of the diverging point P1. The gap sensor 22 has a light-emitting element and light-receiving element opposing each other with the conveyance path interposed therebetween. When a sheet crosses the optical path between the elements, the gap sensor 22 senses the passing of the sheet. Based on the sensing results of the gap sensor, the controller 100 calculates the period ranging from the time when the conveyance-directional rear edge of a certain sheet is detected, to the time when the conveyance-directional front edge of the next sheet is detected. Thus, the gap of any adjacent pair of the sheets successively conveyed is detected.

After that, the controller 100 makes fine adjustments concerning the handling time of the switchback section 1 based on the detected gaps, to thereby make constant the gaps of all sheets passing through the confluence P2. Namely, in the first embodiment, when sheets are fed into the sheet handling apparatus 10 with different gaps, they are sent to the downstream side with the different gaps maintained. In contrast, in the second embodiment, even if sheets are fed into the sheet handling apparatus 20 with different gaps, the gaps are made constant when the sheets pass through the confluence P2.

More specifically, the controller 100 detects, using the gap sensor 22, the gap between the sheet now assigned to the switchback section 1 and the preceding sheet. Subsequently, the controller 100 makes fine adjustments concerning the rotational speed of the switchback roller 11, to increase the period of handling the sheet assigned to the switchback section 1, if the detected gap is less than a predetermined value, and to reduce the period if the detected gap is greater than the predetermined value. The handling period in the switchback section 1 can be adjusted by changing, for example, the stop period $T_4$ [s], in which the switchback roller 11 is stopped, after the assigned sheet is fed into the nip 13.

As described above, the second embodiment can provide the same advantage as the first embodiment, and also can adjust the gaps between sheets, thereby realizing further reliable conveyance control.

Figure 8:
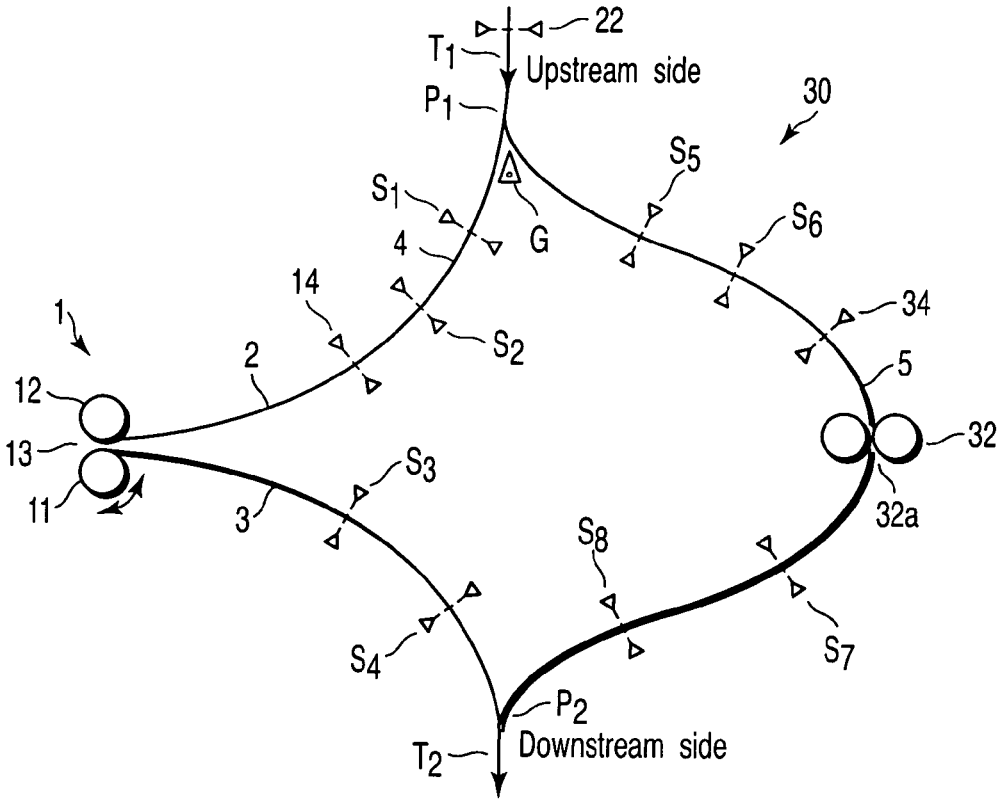
FIG. 8 is a schematic view illustrating the configuration of the essential parts of a sheet handling apparatus according to a third embodiment of the invention.
Figure 9:
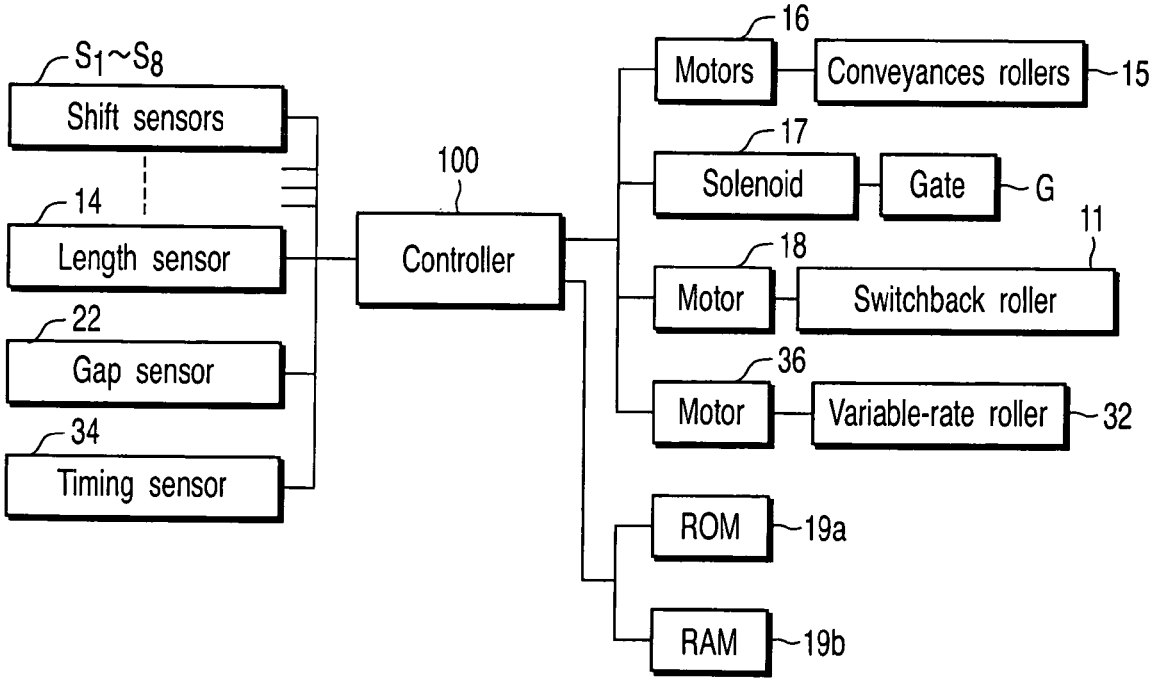
FIG. 9 is a block diagram illustrating a control system for controlling the operation of the sheet handling apparatus of FIG. 8.
Figure 10:
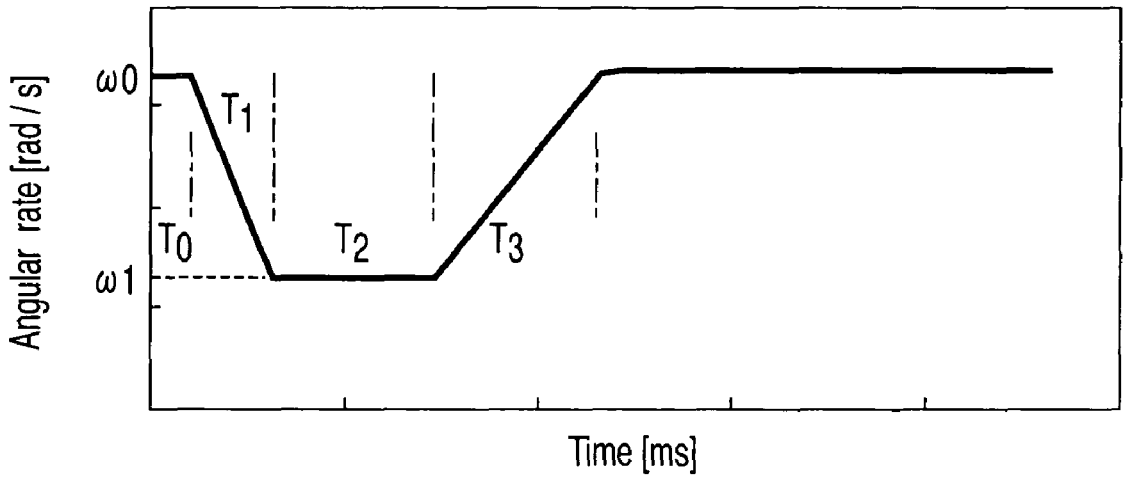
FIG. 10 is a timing chart illustrating a control example of a variable-rate roller incorporated in the sheet handling apparatus of FIG. 8.

Referring then to FIGS. 8 to 10, a description will be given of a sheet handling apparatus 30 according to a third embodiment. The sheet handling apparatus 30 is similar to the sheet handling apparatus 20 of the second embodiment, except that the former employs a variable-rate roller 32 and timing sensor 34. Therefore, in the third embodiment, elements similar to those of the second embodiment are denoted by corresponding reference numerals, and no detailed description is given thereof. The variable-rate roller 32 is located at the middle portion of the straight path 5 and used to change the sheet conveyance rate. The timing sensor 34 is located across the straight path 5 upstream of the variable-rate roller 32.

In the above-described second embodiment, the controller 100 monitors the gaps of sheets successively conveyed, using the gap sensor 22, and performs control to change the handling period of the switchback section 1, if the gap between the sheet assigned to the switchback section 1 and the preceding sheet is less or greater than a predetermined value. This means that the gap between sheets that are not assigned to the switchback section 1, i.e., the gap between a sheet assigned to the straight path 5 and the preceding sheet, cannot be adjusted. In contrast, in the third embodiment, fine adjustments can also be performed on the gaps between the sheets assigned to the straight path 5.

For instance, when the gap between a sheet assigned to the straight path 5 and the preceding sheet is less than a predetermined value, the controller 100 controls the rotation of the variable-rate roller 32 as shown in FIG. 10. That is, the controller 100 adjusts the circumferential rate of the variable-rate roller 32 to the same value as the conveyance rate of the straight path 5 after it detects the front edge of the sheet using the timing sensor 34, before a period $T_0$ [s] in which the front edge of the sheet reaches the nip 32*a* of the variable-rate roller 32 elapses. At this time, the angular rate of the variable-rate roller 32 is $\omega_0$ [rad/s]. After the sheet is fed into the nip 32*a*, the controller 100 decelerates the variable-rate roller 32 by a period $T_1$ [s], and maintains it at $\omega_1$ [rad/s] by a period $T_2$ [s]. After that, the controller 100 decelerates the variable-rate roller 32 by a period $T_3$ [s], i.e., accelerates it from $\omega_1$ [rad/s] to $\omega_0$ [rad/s], thereby returning the circumferential rate of the variable-rate roller 32 to the same rate as the conveyance rate of the straight path 5.

As described above, the third embodiment can provide the same advantage as the second embodiment, and also can adjust the gap between a sheet assigned to the straight path 5 and the preceding sheet. Namely, the gaps of all sheets fed into the sheet handling apparatus 30 can be maintained at an appropriate value.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet handling apparatus comprising:

a switchback section which reverses a conveyance direction of sheets;

a switchback path which conveys sheets via the switchback section;

a straight path which extends between a diverging point and a confluence and bypasses the switchback section, the switchback path and the straight path diverging at a the diverging point and joining at the confluence;

a first rate-sensing section which includes a first sensor provided along the switchback path, and senses a sheet conveyance rate of the switchback path based on an output of the first sensor;

a second rate-sensing section which includes a second sensor provided along the straight path, and senses a sheet conveyance rate of the straight path based on an output of the second sensor; and a control section which controls, based on sensing results of the first rate-sensing section and the second rate-sensing section, a time required for the switchback section to handle a sheet assigned thereto to make a time required for the assigned sheet to pass through the switchback path extending from the diverging point to the confluence via the switchback section, equal to a time required for a sheet to pass through the straight path extending from the diverging point to the confluence.

2. The sheet handling apparatus according to claim 1, further comprising a length-sensing section which senses a conveyance-directional length of a sheet assigned to be conveyed to the switchback section, and wherein the control section controls the switchback section based on sensing results of the length-sensing section, the first rate-sensing section and the second rate-sensing section.

3. The sheet handling apparatus according to claim 1, wherein the control section controls the time required for the switchback section to handle the assigned sheet to satisfy $L_{st}/V_{st}=(L_{sb}-L_{m(x)})/V_{sb}+T_{sb(x)}$, $L_{sb}$ [m] being a sum of a length of the switchback path between the diverging point and the switchback section, and a length of the switchback path between the switchback section and the confluence, Lst [m] being a length of the straight path between the diverging point and the confluence, $L_{st}$ [m] being a length of the straight path between the diverging point and the confluence, $L_{m(x)}$ [m] being a conveyance-directional length of the assigned sheet sensed by the length-sensing section, $V_{sb}$ [m/s] being a sheet conveyance rate of the switchback path sensed by the first rate-sensing section, $V_{st}$ [m/s] being a sheet conveyance rate of the straight path sensed by the second rate-sensing section, and $T_{sb(x)}$ [s] being the time required for the switchback section to handle the assigned sheet.

4. The sheet handling apparatus according to claim 1, wherein the first and second rate-sensing sections each sense an average conveyance rate of sheets.

5. A sheet handling apparatus comprising:

a switchback section which reverses a conveyance direction of sheets;

a switchback path which conveys sheets via the switchback section;

a straight path which extends between a diverging point and a confluence and bypasses the switchback section, the switchback path and the straight path diverging at the diverging point and joining at the confluence;

a first rate-sensing section which includes a first sensor provided along the switchback path, and senses a sheet conveyance rate of the switchback path based on an output of the first sensor;

a second rate-sensing section which includes a second sensor provided along the straight path, and senses a sheet conveyance rate of the straight path based on an output of the second sensor;

a gap-sensing section which senses gaps between sheets directed to the diverging point; and a control section which controls, based on sensing results of the first rate-sensing section, the second rate-sensing section and the gap-sensing section, a time required for the switchback section to handle a sheet assigned thereto to make constant gaps between sheets passing through the confluence.

6. The sheet handling apparatus according to claim 5, further comprising a length-sensing section which senses a conveyance-directional length of a sheet assigned to be conveyed to the switchback section, and wherein the control section controls the switchback section based on sensing results of the length-sensing section, the first rate-sensing section, the second rate-sensing section and the gap-sensing section.

7. The sheet handling apparatus according to claim 5, wherein the first and second rate-sensing sections each sense an average conveyance rate of sheets.

8. A sheet handling apparatus comprising:

a switchback section which reverses a conveyance direction of sheets;

a switchback path which conveys sheets via the switchback section;

a straight path which extends between a diverging point and a confluence and bypasses the switchback section, the switchback path and the straight path diverging at a the diverging point and joining at the confluence;

a conveyance section provided across a middle portion of the straight path and configured to vary a conveyance rate of each sheet conveyed through the straight path;

a first rate-sensing section which includes a first sensor provided along the switchback path, and senses a sheet conveyance rate of the switchback path based on an output of the first sensor;

a second rate-sensing section which includes a second sensor provided along the straight path, and senses a sheet conveyance rate of the straight path based on an output of the second sensor;

a gap-sensing section which senses gaps between sheets directed to the diverging point; and a control section which controls at least one of the switchback section and the conveyance section based on sensing results of the first rate-sensing section, the second rate-sensing section and the gap-sensing section, to control at least one of a handling period of a sheet assigned to the switchback section and a conveyance rate of a sheet directed to the straight path, in order to make constant gaps between sheets passing through the confluence.

9. The sheet handling apparatus according to claim 8, further comprising a length-sensing section which senses a conveyance-directional length of a sheet assigned to be conveyed to the switchback section, and wherein the control section controls at least one of the handling period of the sheet assigned to the switchback section and the conveyance rate of the sheet directed to the straight path, based an sensing results of the length-sensing section, the first rate-sensing section, the second rate-sensing section and the gap-sensing section.

10. The sheet handling apparatus according to claim 8, wherein the first and second rate-sensing sections each sense an average conveyance rate of sheets.

* * * * *